US005379892A

United States Patent [19]

Reams et al.

[11] Patent Number: 5,379,892

[45] Date of Patent: Jan. 10, 1995

[54] PROTECTIVE DISPLAY CASE FOR COLLECTIBLE ITEMS

[76] Inventors: William H. Reams, 19200 Geeting Rd., Keedysville, Md. 21756; Charles K. Bird, 5307 Sovereign Pl., Frederick, Md. 21701

[21] Appl. No.: 132,891

[22] Filed: Oct. 7, 1993

[51] Int. Cl.[6] ..... B65D 85/00

[52] U.S. Cl. ..... 206/315.9; 206/45.14

[58] Field of Search ..... 206/315.9, 45.14, 45.19, 206/45.34, 583; 273/60 R, 61 R

[56] References Cited

U.S. PATENT DOCUMENTS

| | | | |
|---|---|---|---|
| 2,115,309 | 4/1938 | Koch | 206/45.34 X |
| 2,120,826 | 6/1938 | Young | 206/45.14 X |
| 2,176,955 | 10/1939 | Clow | 206/45.34 |
| 2,274,196 | 2/1942 | Gilbert | 206/45.19 |
| 2,859,893 | 11/1958 | Reed | 206/45.34 |
| 3,047,140 | 7/1962 | Robins | 206/315.9 |
| 3,324,994 | 6/1967 | Rauser, Sr. | 206/45.14 X |
| 3,777,933 | 12/1973 | Joliot | 206/316.9 X |
| 3,907,108 | 9/1975 | Weimer, Jr. | 206/45.14 X |
| 4,124,117 | 11/1978 | Rudy | 206/315.9 X |
| 4,159,765 | 7/1979 | Roccaforte | 206/45.14 X |
| 4,193,531 | 3/1980 | Saby | 206/583 X |
| 4,214,684 | 7/1980 | Galowitz | 206/315.9 |
| 4,267,928 | 5/1981 | Curry, Jr. | 206/583 |
| 4,494,650 | 1/1985 | Cullen | 206/45.34 |
| 4,993,548 | 2/1991 | Peterson | 206/315.9 X |
| 5,082,110 | 1/1992 | Hager | 206/315.9 X |
| 5,165,538 | 11/1992 | Peters | 206/315.9 |

*Primary Examiner*—Paul T. Sewell
*Assistant Examiner*—Ted Kavanaugh

[57] ABSTRACT

The subject device is a holder to protect and display baseballs and other collectible items. It comprises a rigid transparent tube which contains the baseballs and through which they can be viewed, one end cap at each end of the transparent tube to retain the balls, a rigid backboard to which the end caps are attached for the purpose of holding the end caps in their fixed rigid position.

1 Claim, 2 Drawing Sheets

PROTECTIVE DISPLAY CASE FOR COLLECTIBLE ITEMS

BACKGROUND

1. Field of Invention

This invention relates to the protective long-term storage of a variety of collectibles ranging from but not limited to autographed baseballs, baseball bats, hockey pucks, golf balls, footballs, and other collectible items.

BACKGROUND

2. Description of Prior Art

Sports enthusiasts and collectors of a wide variety of items are concerned with displaying and protecting their often expensive collectibles. For example, professional athletes autograph articles singly or in groupings representing specific teams or particular performance accomplishments of their careers. These articles may be golf balls, baseballs, baseball bats, hockey pucks, footballs, tennis balls, or other collectible items.

The economic value of these sports balls is dependent primarily upon their age, physical condition, and rarity and number of autographs visible upon the ball. The earliest patent, U.S. Pat. No. 5,165,538 to W. H. Peters dated Nov. 24, 1992, is for a case that holds only a single baseball in a transparent plastic sphere. The case consists of a base member that is intended to be set horizontally on a flat surface, a bottom half a plastic sphere, and a matching top half of the sphere. Made of a thin plastic , it is susceptible to scratching and denting. The gold paint on the plastic base is susceptible to flaking leaving the display looking less than attractive. There is no means of providing tamper proof security for this display. The top half of the sphere is easily removed to gain access to the ball. This is an undesirable feature for a prized ball or collectible item.

A subsequent patent, U.S. Pat. No. 5,082,110 to Alan C. Hager dated Jan. 21, 1992, also encases only a single ball in a permanent mounting that once glued together cannot not be removed without permanently damaging the display case. The case employs two transparent plastic components: a flat circular base plate and a hemispherical top together adapted to receive a single baseball and join to the base plate. Although it provides better security than the earlier patent, it offers no flexibility since its sealed joint must be destroyed to remove the ball. Once this is done, the case cannot be used again to display another ball. This patent also displays only a single ball.

Earlier known enclosures for displaying baseballs were not tamper proof and did not preserve the condition of the baseball and autograph(s) adequately. In some cases solvent vapors have been found to adversely affect the leather covering of the baseball, and the ink used in the signatures. Also, other display cases do not immobilize the ball.

It is important to be able to display multiple collectible items. Many collectors have baseballs they want to display in a group such as those pitchers who were Cy Young Award winners, Hall of Fame inductess, Golden Glove Award recipients, Rookies of the Year, Most Valuable Players, team members of a particular year and team, etc. To do this it is necessary to have the capability to display multiple items. Another deficiency of the prior art is that the displays are intended to used only on a flat horizontal surface such as a table top.

Frequently it is desired to display collectibles in a case hung from the wall.

The overall appearance of the display case is also worthy of discussion. A display should not be a distraction but rather enhance the quality of the item. The materials used in the display case should emphasize durability and not deteriorate, crack, or peel over time.

OBJECTS AND ADVANTAGES

Accordingly, besides the objects and advantages of the collectibles display cases described in our above patent, several objects and advantages of the present invention are:

(a) To provide a display case of such width and length as to accomodate single or multiple items of like or dissimilar items for display;

(b) To provide the capability to secure the collectibles so that they are protected yet can be removed and the case reused for subsequent displays;

(c) To provide a means of immobilizing the display items so that they will maintain their orientations while in the display case;

(d) To provide the flexibility to place the collectibles display case in vertical to horizontal orientations on both horizontal surfaces and wall mountings;

(e) To provide a durable display of the highest quality transparent tubing of high optical clarity and a variety of high quality end caps which will maintain the collectibles in optimal condition;

(f) Further objects and advantages of our invention will become apparent from a consideration of the drawings and ensuing description.

DRAWING FIGURES

Figure 1:
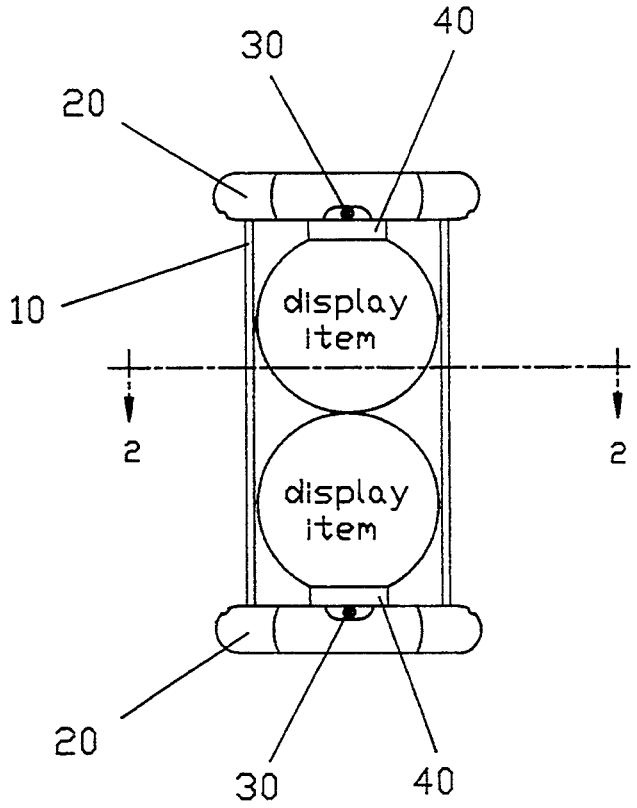
FIG. 1 illustrates a configuration of the display case for placement on a horizontal surface.
Figure 2:
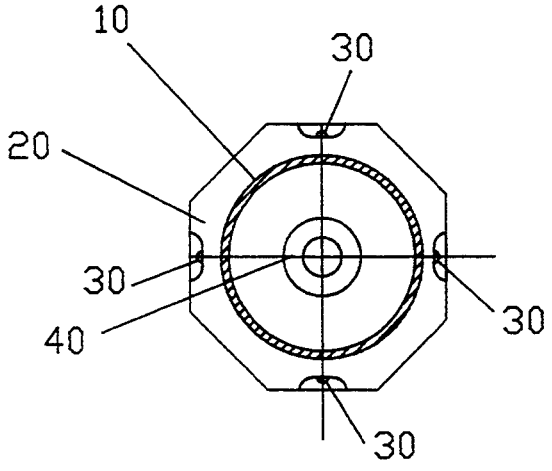
FIG. 2 is a cross-sectional view taken through line 2—2 in FIG. 1.
Figure 3:
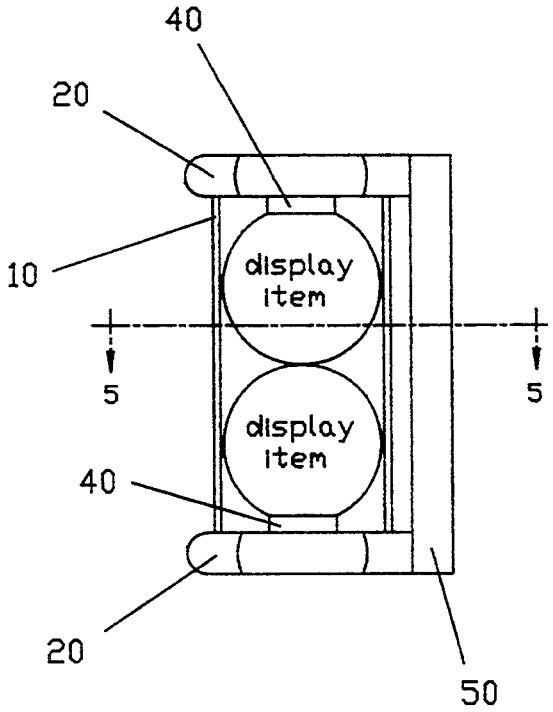
FIG. 3 illustrates a configuration of the display case for placement on a horizontal surface and for wall mounting.
Figure 4:
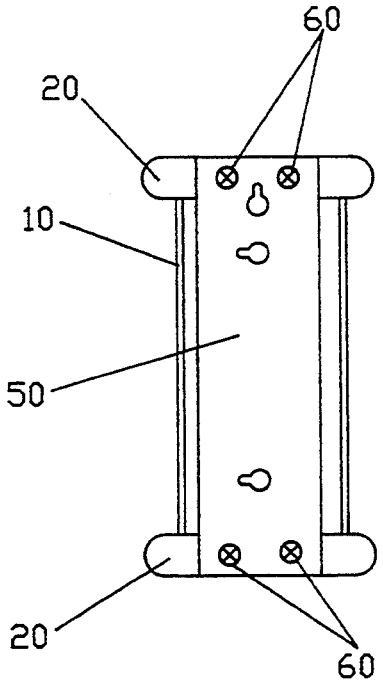
FIG. 4 illustrates a right side view of the display case in FIG. 3.
Figure 5:
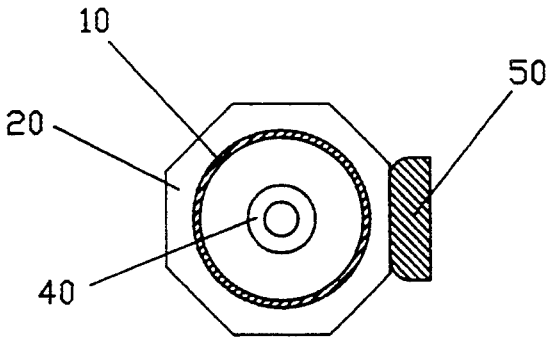
FIG. 5 is a cross-sectional view taken through line 5—5 in FIG. 3.

| Reference Numerals in Drawings | |
|---|---|
| 10 transparent tube | 20 end cap |
| 30 short screw | 40 resilient spacer |
| 50 mount | 60 long screw |

DESCRIPTION FIGS. 1–2

FIGURE 1–2

This display case is configured for placement on a horizontal surface and consists of a transparent tube-10 of round or other shape disposed between end caps-20 which are held in fixed position at each end of the transparent tube-10 by short screws-30 projecting radially from the edge of the end caps-20 and through the wall of the transparent tube-10. Short screws-30 are readily removable to disassemble the display case to allow for replacement and rearrangement of displayed items. Dimensions of transparent tube-10, end caps-20, and resilient spacers-40 to slightly compress causing a biasing force against the display items to prevent motion of the items in the assembled display case.

FIGURE 3–5

This display case as configured for wall mounting consists of transparent tube-10 of round or other shape disposed between end caps-20 which are held in fixed position at each end of the transparent tube-10 by being attached to mount-50 with long screws-60. Long screws-60 are readily removable to disassemble the display case to allow for replacement and rearrangement of displayed items. Dimensions of transparent tube-10, end caps-20, mount-50, and resilient spacers-40 are designed to cause the resilient spacers-40 to slightly compress causing a bias force against the display items which prevents relative motion of the items within the assembled case.

Obviously, many modifications and variations of the present invention are possible in light of the above teachings. It is, therefore, to be understood that this invention is limited only by the scope of the claims annexed hereto.

We claim:

1. A display case for the storage and display of a plurality of collectible items, said case comprising:

a transparent cylindrical tube, two end caps, each end cap having a diameter larger than the diameter of the cylindrical tube, said end caps each having a cavity centrally located on one side of the end cap, a pair of cylindrical resilient spacers, each spacer being held in a fixed position central to one of said end caps by said cavity in the end cap, each spacer located on the side of the end cap opposite from the cavity, a mount having a length longer than the length of the cylindrical tube and having keyhole slots on the exterior side to permit the display case to hang in a vertical or horizontal orientation, each of said end cap mounted to one end of said mount by screws, said transparent cylindrical tube disposed between said two end caps which are held in a fixed position at each end of the transparent tube by said mount, said end caps attached to the mount by the screws which are readily removable to disengage the display case to allow for replacement and rearrangement of the items within the display case, and the length of the tube and the thickness of the spacers being chosen such that each said resilient spacer will compress when engaging the collectible items causing a biasing force against the collectible items to prevent motion of the items in the display case.

* * * * *